United States Patent [19]

Allen

[11] 4,349,294

[45] Sep. 14, 1982

[54] CONCRETE TOPPING SPREADER SYSTEM

[75] Inventor: J. Dewayne Allen, Paragould, Ark.

[73] Assignee: Allen Engineering Corporation, Paragould, Ark.

[21] Appl. No.: 170,126

[22] Filed: Jul. 18, 1980

[51] Int. Cl.[3] ..... E01C 19/18

[52] U.S. Cl. ..... 404/110; 404/101; 222/556; 239/668

[58] Field of Search ..... 404/102, 111, 108, 107, 404/105, 106, 114, 119, 110, 101, 113; 239/659, 668, 650; 222/625, 556, 311, 410, 465

[56] References Cited

U.S. PATENT DOCUMENTS

| | | | |
|---|---|---|---|
| 690,913 | 1/1902 | Albertson | 222/625 X |
| 954,266 | 4/1910 | Doud | 404/109 X |
| 1,062,613 | 5/1913 | Smith | 404/110 X |
| 1,105,502 | 3/1929 | Schellentrager | 222/626 X |
| 1,724,043 | 8/1929 | Robb | 404/106 |
| 1,858,645 | 5/1932 | Smoot | 404/110 X |
| 1,974,013 | 9/1934 | Clausen | 404/106 |
| 2,346,378 | 4/1944 | Jackson | 404/114 |
| 2,660,937 | 12/1953 | Breeden | 404/105 X |
| 2,663,231 | 12/1953 | Wood | 404/110 |
| 2,789,485 | 4/1957 | Lindgren | 404/106 |
| 2,906,438 | 9/1959 | Carpenter | 222/625 X |
| 2,957,396 | 10/1960 | Bederman | 404/119 |
| 2,962,785 | 12/1960 | Young | 404/113 X |
| 2,989,930 | 6/1961 | Flowers | 404/108 X |
| 3,029,714 | 4/1962 | Creswell | 404/110 |
| 3,043,201 | 7/1962 | Maxon | 404/106 |
| 3,135,178 | 6/1964 | Guntert | 404/108 |
| 3,453,988 | 7/1969 | Trent | 404/119 X |
| 3,868,200 | 2/1975 | Bratchell | 404/108 X |
| 3,916,949 | 11/1975 | Armstrong | 222/556 X |
| 4,157,769 | 6/1979 | Radel | 222/608 X |

FOREIGN PATENT DOCUMENTS

| | | | |
|---|---|---|---|
| 460637 | 10/1928 | Fed. Rep. of Germany . | |
| 1104039 | 11/1955 | France | 404/106 |

*Primary Examiner*—Nile C. Byers, Jr.

*Attorney, Agent, or Firm*—Cahill, Sutton & Thomas

[57] ABSTRACT

The present invention uniformly spreads a topping material over a wet concrete surface and includes a spreader, a bridge and a drive system. The spreader stores a supply of topping material and dispenses a uniformly wide layer of the topping material as it is translated along the bridge. The bridge supports the spreader above the wet concrete surface and spans the entire width of the concrete surface. The drive systems translates the spreader across the bridge to dispense a uniformly wide layer of topping material over the concrete surface. Sequential lateral translations of the spreader across the bridge followed by sequential lateral translations of the bridge along the length of the concrete surface covers the entire concrete surface with a uniform layer of topping material.

11 Claims, 13 Drawing Figures

CONCRETE TOPPING SPREADER SYSTEM

BACKGROUND OF THE INVENTION

1. Field of the Invention

The present invention relates to spreaders, and more particularly, to spreaders which are translated above and uncured surface of a material which cannot support the spreader. This Application is a continuation-in-part of U.S. application Ser. No. 101,545 filed Dec. 10, 1979.

2. Description of the Prior Art

The prior art includes a variety of different types of material spreaders. U.S. Pat. No. 2,806,435 (Mundell) discloses a suspended refuse spreader which includes a hopper which is translatable along the length of a pair of fixed, overhead rails. The hopper of this spreader hangs below these fixed support rails and includes a plow-like deflector which deflects the refuse into two spaced apart piles as the spreader is translated along the rails. A cable is attached to one end of the spreader to translate the spreader with respect to the supporting rails.

U.S. Pat. No. 2,807,234 (Middlen) discloses an engine-driven livestock feeding apparatus which can be translated along a pair of fixed rails between which a livestock feed trough is positioned. The material discharged from the lower portion of this apparatus is separated by a deflector within the trough into two heaps so that cattle on both sides of the rail system can be fed.

U.S. Pat. No. 1,200,393 (Neller) discloses an overhead carrier which is translated along a single fixed overhead rail. When the carrier reaches the desired unloading position, the hopper of the carrier is tilted sideways to discharge the contents.

U.S. Pat. No. 3,230,845 (Mauldin) discloses a spreader which rolls over and is supported by the surface upon which material is to be spread. U.S. Pat. No. 3,453,988 (Trent) discloses a portable spreader which is linearly translatable along the length of a pair of fixed rails.

U.S. Pat. No. 2,113,503 (Belkesley) discloses a multiple-purpose spreader which includes a hopper supported by a grouping of three wheels. This topping spreader rolls over the area upon which material is to be discharged.

U.S. Pat. No. 2,318,064 (Delaney) discloses a conventional fertilizer spreader which includes a hopper and a finger agitator rotated by the spreader wheels. A mechanically actuated gate is positioned in the lower portion of the hopper and meters the discharge of material from the spreader.

SUMMARY OF THE INVENTION

The present invention contemplates a concrete topping spreader which uniformly spreads a topping material over a wet concrete surface having a length, a width and opposing sides. This apparatus includes a spreader which stores a supply of topping material and dispenses a uniformly wide layer of the topping material as the spreader is translated along a path. Bridge means is supported above and spans the width of the concrete surface and is laterally translatable along the length of the concrete surface. The bridge means provides a path to translate the spreader across the width of the concrete surface. Drive means is coupled to the spreader and translates the spreader across the path formed by the bridge means to thereby dispense a uniform layer of topping material over the concrete surface. Sequential translations of the spreader across the bridge means followed by sequential lateral translations of the bridge means along the length of the concrete surface in displacements equal to the width of the layer of topping material dispensed by the spreader covers the entire concrete surface with a uniform layer of topping material.

DESCRIPTION OF THE DRAWING

The invention is pointed out with particularity in the appended claims. However, other objects and advantages together with the operation of the invention may be better understood by reference to the following detailed description taken in conjunction with the following illustrations wherein:

FIG. 6A illustrates the gate in the closed position while FIG. 6B illustrates the gate in the open position.

DETAILED DESCRIPTION OF THE INVENTION

In order to better illustrate the advantages of the invention and its contributions to the art, the various mechanical features of the preferred embodiment of the invention will be reviewed in detail.

Figure 1:
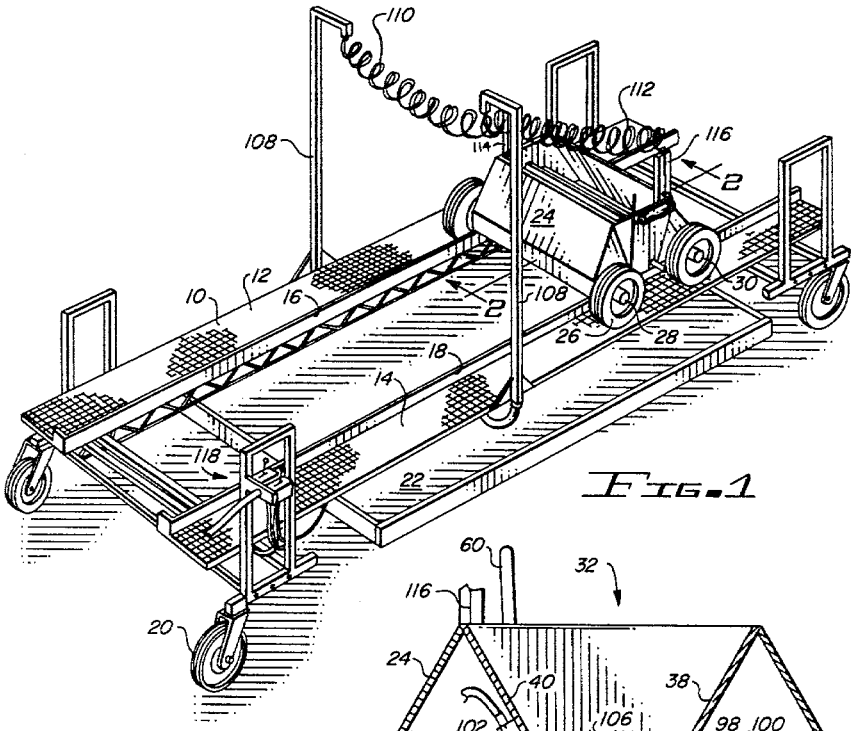
FIG. 1 is a perspective view of the concrete topping spreader system of the present invention.

Referring now to FIG. 1, a multi-section, variable length bridge 10 includes parallel spans 12 and 14. Vertically oriented guide rails 16 and 18 are positioned as shown on the innermost sections of spans 12 and 14. Bridge 10 is supported by a plurality of wheels 20 which are of a fully castering design to facilitate movement and positioning of bridge 10. Bridge 10 is fabricated in sections generally five to ten feet long. A short single section bridge length is illustrated in FIG. 1, but multiple bridge sections can be readily coupled together to form an overall bridge length of sicty-five feet or longer. Bridge 10 is positioned over the upper surface of an area of wet concrete 22. Wheels 20 of bridge 10 are supported either on solid ground, a solid previously dryed concrete surface, of any other firm, non-yielding surface.

Referring now generally to FIGS. 1-5, spreader 24 includes four rubber pneumatic tires 26. Wheels 26 are rotatably coupled to spreader 24 by axles 28 and 30. Spreader 24 includes a hopper 32 having first and second planar side members 34 and 36 and first and second planar end members 38 and 40. End members 38 and 40 are inclined with respect to the vertical axis of spreader 24 and the lower edges of these end members converge to form an elongated slot 42 extending widthwise of the spreader.

Figure 5:
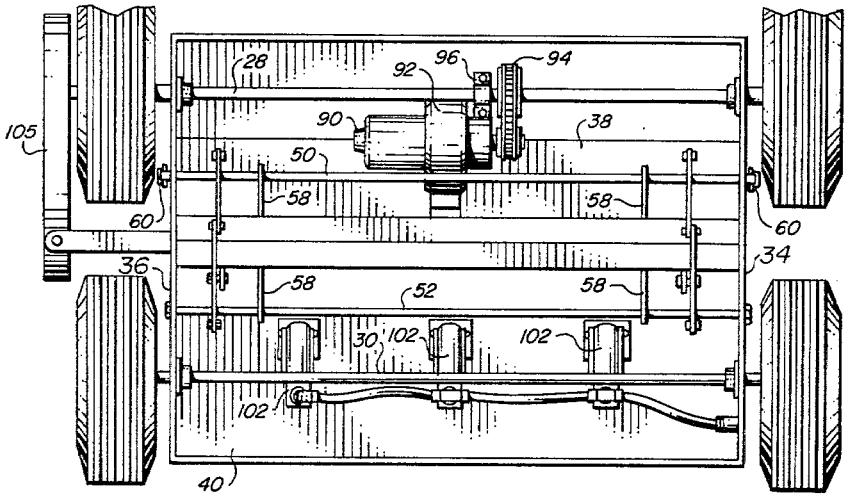
FIG. 5 is a view from below of the spreader illustrated in FIG. 1.
Figure 6A:
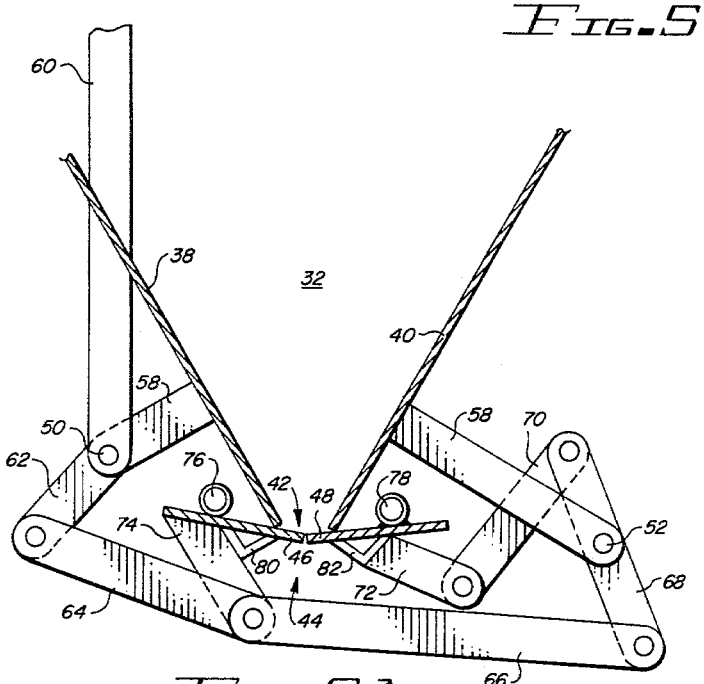
FIGS. 6A and 6B illustrate the spreader gate and linkage which is coupled to the lower portion of the hopper.
Figure 6B:
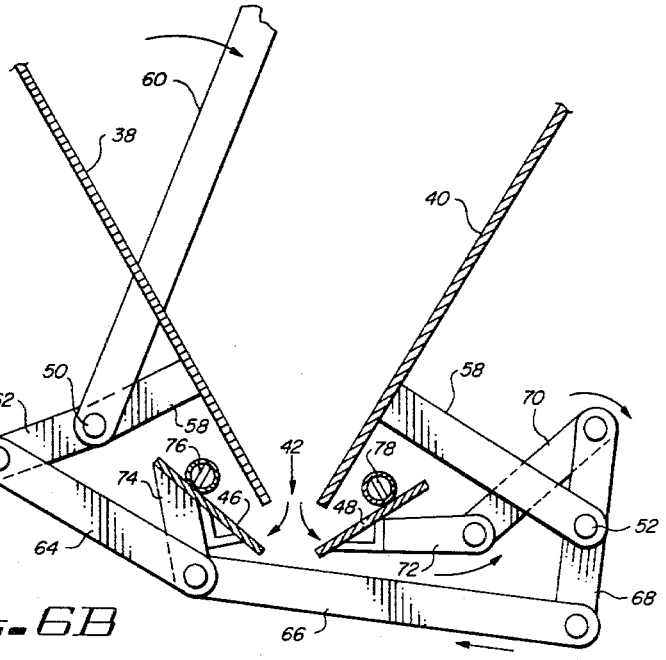

Referring now also to FIGS. 6A and 6B, a gate 44 includes clam shell doors 46 and 48. The linkage which actuates clam shell doors 46 and 48 will be discussed in detail by referring to FIGS. 5, 6A and 6B. Rods 50 and 52 extend through the lower portion of side members 34 and 36 of spreader 24 and rotatable with respect to side members 34 and 36. A group of four standoffs 58 are rigidly mounted to end members 38 and 40 of hopper 32. Rods 50 and 52 are freely rotable with respect to standoffs 58. On each side of spreader 24 a gate actuator arm 60 is rigidly coupled to rod 50 and extends vertically upward. Rotational displacement of arm 60 causes rod 50 to rotate and thereby rotationally displaces linkage elements 62, 64, 66, 68, 70, 72 and 74 as is illustrated in FIGS. 6A and 6B. Clam shell doors 46 and 48 are rotably coupled to side members 34 and 36 of spreader 24 by rods 76 and 78. Reinforcing elements 80 and 82 are coupled to the lower surfaces of clam shell gates 46 and 48 to provide additional strength and rigidity.

Figure 3:
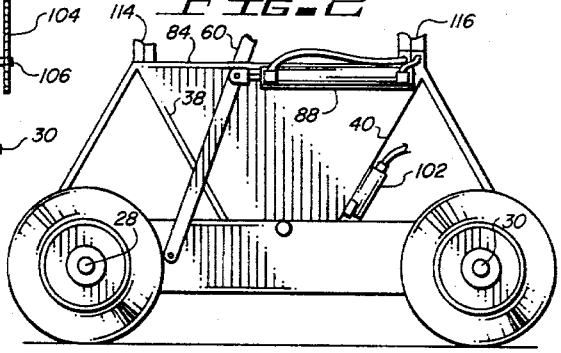
FIG. 3 is a side view, taken from the left-hand side, of the spreader illustrated in FIG. 1.

A flange 84 extends horizontally outward from the upper side surfaces of spreader 24 and an actuator arm 60 extends vertically upward through slot 86 in flange 84. Actuator arm 60 is in a vertical position when gate 44 is closed over slot 42. In this closed position actuator arm 60 contacts and is stopped by the end of slot 86. A clamp can be positioned at a predetermined distance along the length of slot 86 in an arrangement which prevents further movement of actuator arm 60 along the length of slot 86. Clamps can thus be applied to flanges 84 to limit the maximum open position of gate 44. FIG. 3 best illustrates the manner in which pneumatic actuator 88 includes a cylinder which is secured to the side of spreader 24. An actuator arm of actuator 88 is coupled to gate actuator arm 60.

Figure 2:
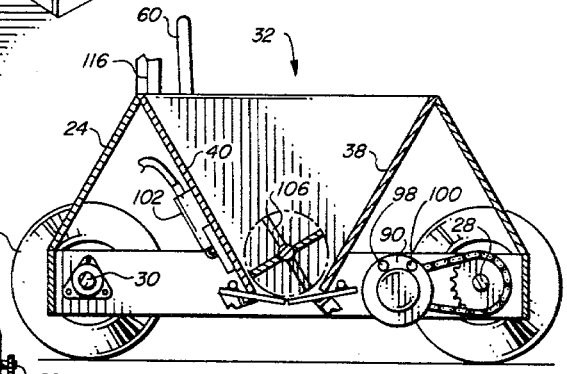
FIG. 2 is a sectional view of the spreader illustrated in FIG. 1, taken along section line 2—2.

Referring now to FIGS. 2 and 5, a 1.3 horsepower sixty PSI high torque pneumatic motor 90 is coupled to end member 38 of hopper 32 by a mounting bracket 92. Motor 90 is commercially available from the Gast Manufacturing Company of Benton Harbor, Michigan (model number 4AM-RV-75-GR20). Sprocket wheels on the output drive shaft of motor 90 and on axle 28 provide a ten to one gear reduction and are coupled together by a drive chain 94. An additional bearing block 96 is coupled to the inner surface of the housing of spreader 24 to more rigidly support axle 28 in the vicinity of motor 90. Motor 90 can be operated in either a forward or a reverse direction depending on whether pressurized air is coupled to port 98 or port 100.

A plurality of three pneumatic air vibrators 102 are coupled to end member 40 of hopper 32 as is best illustrated in FIG. 5. When pressurized air is supplied to the input ports of each of these air vibrators, a weighted piston within the cylinder of each device vibrates up and down along the vertical axis of the device. This piston reciprocates at a rate of ten thousand cycles per minute. Pneumatic air vibrators of this type are commercially available from the Navco Manufacturing Company. Note that each of these vibrators is positioned near the lowermost portion of hopper 32 and that these vibrators are separated by a uniform spacing along the width of hopper 32. Air vibrators 102 commence operation when actuator 88 is operated to open gate 44. The vibrations produced by air vibrators 102 causes the topping material within hopper 32 to be uniformly metered from gate 44 and prevents undesired particle build ups in hopper 32.

Figure 4:
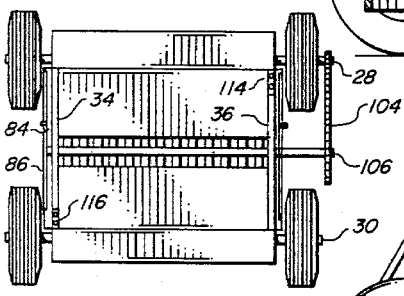
FIG. 4 is a view from above of the spreader illustrated in FIG. 1.

Referring now to FIGS. 4 and 5, a chain 104 surrounds a pair of sprocket wheels which are coupled to the shaft of finger agitator 106 and to axle 28. A chain guard 105 is positioned around chain 104 and serves as a protective device. Since wheels 26 are rigidly coupled to axle 28 the linear translation of spreader 24 along bridge 10 rotates wheels 26 and rotates finger agitator 106 at a rate directly proportional to the rate of translation of spreader 24. Faster movement of spreader 24 causes more rapid rotation of finger agitator 106 and a more rapid rate of discharge of topping material from gate 44 when it is in the open or partially open position. Thus, a uniform topping discharge density is provided which is not affected by the rate of translation of spreader 24.

Referring now to FIGS. 1-3, a pair of support arms 108 extend vertically upward from the midsection of bridge 10. A pair of coiled, flexible double passageway airhoses 110 and 112 extend from support arms 108 to support arms 114 and 116 on spreader 24. Double passageway airhose 110 and 112 are routed through support arms 108 to a control station 118 on bridge 10. A source of pressurized air (about 60 PSI 25 C.F.M.) is coupled to control station 118.

The pressurized air coupled to support arm 116 operates actuator 88 and pneumatic vibrators 102. The pressurized air supplied to spreader 24 through support arm 114 is coupled to input ports 98 and 100 of motor 90. One of the two valves in control station 118 controls the air pressure directed to actuator 88 and air vibrators 102 while the second control valve regulates the amount and direction of air coupled to motor 90. This second control valve permits motor 90 to be operated in either forward or reverse directions to regulate the direction of travel of spreader 24. Varying the amount of air pressure transmitted to motor 90 can vary the velocity of spreader 24 from a low translation speed of about twenty feet per minute to a high translation speed of about one hundred feet per minute.

The manner of operating and using the concrete topping spreader of the present invention will now be described in some detail. Generally a three man crew is required to operate the topping spreader in the most efficient manner. One crew member is primarily responsible for reloading the hopper with the desired topping material. One man operates the control station to regulate the direction and speed of operation of the spreader across bridge 10. The third man assists in laterally translating bridge 10 along a length of a section on concrete over which the topping material is to be distributed. Many different topping materials such as quartz, mineral, metallic, traprock, emery can be accurately dispensed by the present system.

The desired rate of distribution of topping material is first determined and a clamp or other similar device is positioned along slot 86 of flanges 84. This determines the maximum open position of clam shell gate 44. With typically used topping materials the rate of distribution can be varied from about one tenth of a pound of topping material per square foot to about four pounds per square foot. After the hopper of spreader 24 has been loaded, the operator opens both control valves at control station 118. Actuator 88 is thereby actuated to the open position and motor 90 commences rotation. Rotation of motor 90 causes axle 28 to rotate which rotates chain 104 and thus finger agitator 106. The extreme outer edges of finger agitator 106 are positioned within about one eighth of an inch of end members 38 and 40 of hopper 32 and serves to wipe away any topping material which may have formed an obstruction or bridge and in addition insures a free and uniform flow of topping material through clam shell gate 44 at all times. Air vibrators 102 commence operation when actuator 88 causes gate 44 to open.

After spreader 24 has completely traversed the widthwise span of bridge 10 across concrete surface 22, the spreader is stopped, the bridge is laterally translated a distance equal to the width of topping material previously spread and the spreader is translated over bridge 10 in the opposite direction. This procedure is repeated with intervening reloading steps until the complete surface of the wet concrete has received a layer of topping.

Figures 7, 8:
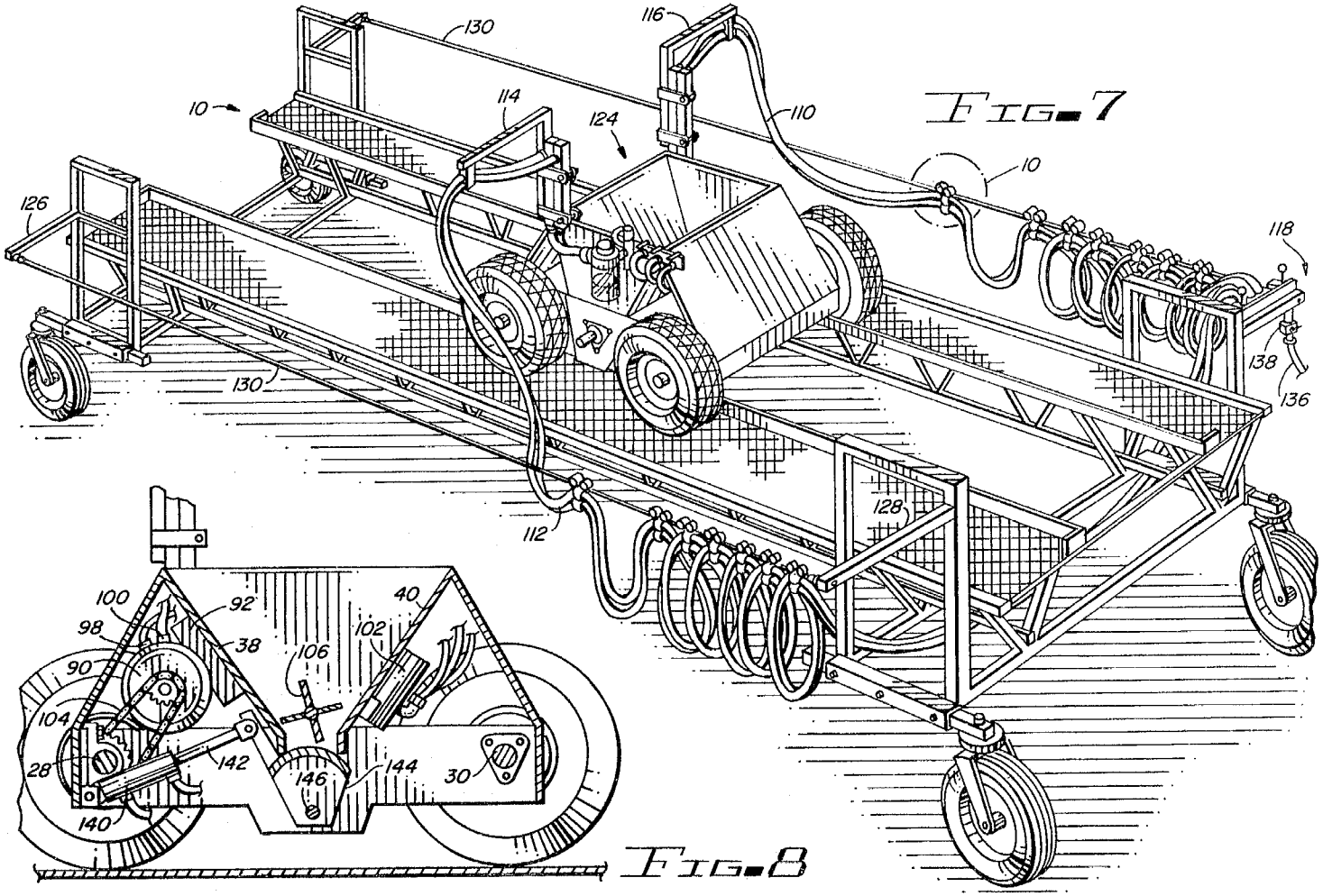
FIG. 7 illustrates a second embodiment of the concrete topping spreader of the present invention which includes a modified lateral support structure for the air supply hose assemblies and a modified spreader gate.
FIG. 8 is a sectional view of the spreader illustrated in FIG. 7.
Figure 9:
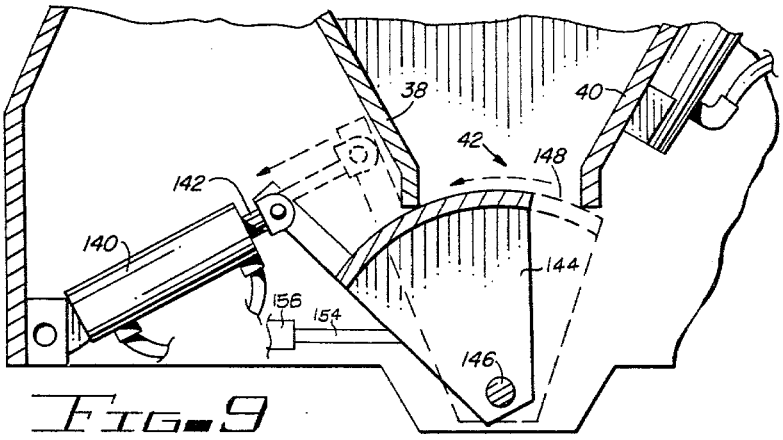
FIG. 9 is a partial sectional view of the spreader illustrated in FIG. 8, illustrating the spreader gate in the "open" and "closed" positions.
Figure 10:
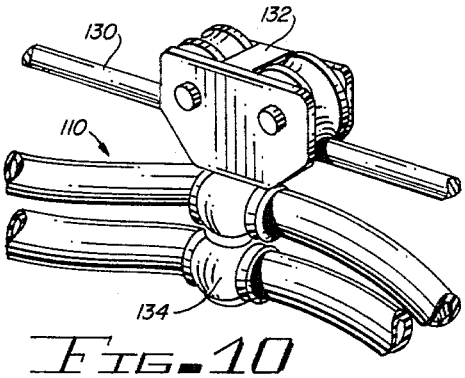
FIG. 10 is an enlarged prospective view of one of the guideblock assemblies illustrated in FIG. 7.

Referring now to FIGS. 7-12, a modified version of the concrete topping spreader will now be described in detail. This modified spreader embodiment illustrated in FIGS. 7-12 will be referred to as spreader 124. FIG. 7 specifically indicates the manner in which dual air hoses 110 and 112 are coupled between bridge 10 and spreader 124. On each side of bridge 10 a pair of outriggers 126 and 128 extend laterally outward and are coupled together by a tightly stretched support cable 130. FIG. 10 specifically indicates that a plurality of laterally translatable guideblocks 132 are coupled at evenly spaced apart invervals to air hose 110. A clamp 134 is coupled to the lower portion of guideblock 132 and includes a pair of cylindrical apertures through which each individual air hose of the dual air hose assembly 110 can be routed. The free end of air hose 110 is coupled to spreader 124 by support 116. The guideblocks are laterally translated back and forth across cable 130 as spreader 124 is translated back and forth across bridge 10. Air hose 112 is coupled to bridge 10 in a similar manner.

Figure 12:
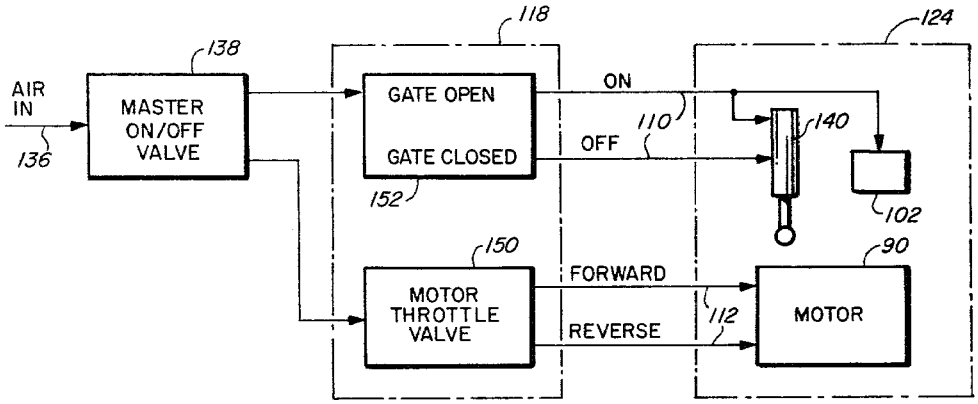
FIG. 12 is a schematic diagram of the pneumatic control and power system for the concrete topping spreader.

Both air hoses 110 and 112 are coupled to a control panel 118. FIGS. 7 and 12 indicate that an air input hose 136 is coupled to master on/off valve 138. Pneumatic valve 150 is coupled to control assembly 118 and air hose 112 and serves as a motor throttle valve. Actuating valve 150 to provide pressurized air to one of the two hoses of hose assembly 112 causes motor 90 to rotate in a forward direction. Controlling the rate of air flow through valve 150 varies the operating speed of motor 90. When pressurized air is coupled by valve 150 to the second air hose of air hose assembly 112, motor 90 rotates in a reverse direction at a rate controlled by the amount of air flow provided.

Control valve 152 in control unit 118 actuates air vibrators 102 and the two pneumatically controlled gate position control cylinders 140. In the first position, valve 152 directs pressurized air through one of the two air hoses in hose assembly 110, causing the shafts of the two air actuator cylinders 140 to be retracted into the position illustrated in FIG. 9. As indicated in FIG. 9, shaft 142 and pneumatic actuator 140 are coupled to gate 144 which pivots about shaft 146 into an open position which establishes a gap indicated by reference number 148 between side surface or first end wall 40 and the smoothly curved cylindrical section which forms the upper surface of gate 144. When control valve 152 is moved into the "off" position, air pressure is removed from the hose which supplies air under pressure to air vibrators 102 and is routed instead to the second air pressure port of actuator cylinders 140. In the "off" position valve 152 directs pressurized air through the second hose of air hose assembly 110 which actuates pneumatic actuator 140 and causes shafts 142 to extend. Extension of shafts 142 rotates gate 144 into the "closed" position and terminates the flow of material through widthwise slot 42 of spreader 124. In FIG. 9 the dotted lines indicate the "closed" position of gate 144.

Figure 11:
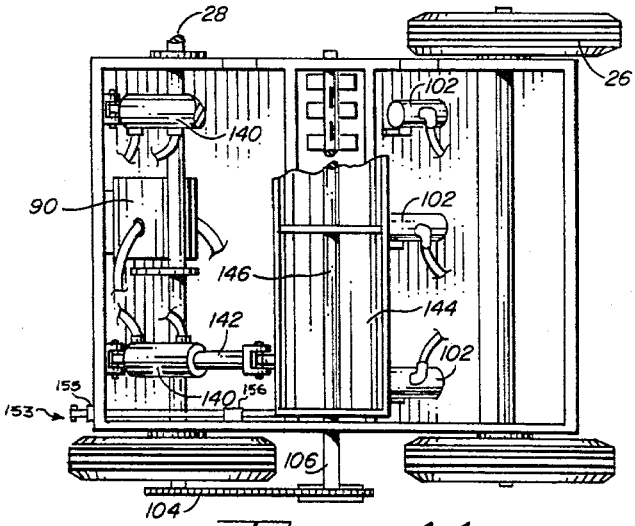
FIG. 11 is a partially cut away view from below of the spreader illustrated in FIG. 8.

Referring now to FIGS. 9 and 11, an adjustable mechanical stop 153 limits the maximum gate displacement into the "open" position to thereby control the rate at which topping is dispensed as spreader 124 is laterally translated. In the preferred embodiment of the present invention, a one inch diameter threaded rod 154 passes through an aperture cut in the lower end wall of the base of spreader 124. A nut 155 is welded to the exterior surface of the base of spreader 124 and causes rotation of rod 154 to displace the end of rod 154 fore and aft with respect to the side of gate 144. A second bolt is welded to the exterior end of rod 154 to permit stop 153 to be readily adjustable by means of a wrench. A hollow tubular support bracket 156 is welded to the interior side surface of the base of spreader 124. Bracket 156 both supports and guides rod 154 and serves to maintain rod 154 in a fixed vertical position with respect to gate 144.

In order to simplify the drawings, only a portion of stop 153 is illustrated in FIG. 9 and only one of the two stops actually used in the preferred embodiment of the present invention is illustrated in FIG. 11. It should be understood that a second stop is provided on the opposite side of the base of spreader 124 so that the one stop abuts each end of gate 144. Generally it will be desirable to either weld a flat plate to gate 144 at the point at which the end of stop 153 will strike the gate or alternatively to form a notch on the end sections of gate 144 so that each end of stop 153 will strike a surface substantially perpendicular to the end of rod 154.

It is generally desirable to fabricate the inclined end members 38 and 40 of the spreader at an angle approaching 45°. The vibrations produced by air vibrators 102 cause end member 40 to form a vibrating feeding surface which prevents the topping material contained within the hopper from adhering to this vibrating surface and insures that the topping will flow downward along end member 40 smoothly and evenly through the gap 148 formed in slot 42. Finger agitator 106 also assists in providing a uniform flow of topping through gap 148 by maintaining the topping material in a fluffed or agitated state. This fluffing action provided by finger agitator 106 prevents compaction of the topping material which in many circumstances would cause an uneven and irregular flow of topping material.

The unique structure of the upper surface of gate 144 which is formed in the shape of a section of the wall of a cylinder produces a sliding contact with the lower surfaces of end members 38 and 40. This unique structure provides a self-cleaning feature of the gate which prevents topping material from adhering to the linear right hand lip surface of gate 144 which defines one side of gap 148. As gate 144 is snapped into the closed position by actuator cylinders 140, the scraping action between the lower edge of end member 40 and the curved upper lip surface of gate 144 removes all topping from the gate lip.

Stops 153 must be adjusted to the desired setting before the spreading operation is commenced. For many standard types of topping material, the two stops are adjusted so that a ⅛" gap is established at gap 148 when gate 144 is in the open position. The dimension of gap 148 must always be greater than the diameter of the material to be spread.

Continuously maintaining the self-cleaning lip of gate 144 in a clean condition, the ability to precisely control the dimension of gap 148, the continuous vibration of end member 40, and the constant translation velocity of spreader 124 enables the present invention to uniformly spread topping material with a distribution accuracy of two or three percent which has previously been unobtainable by any prior art device or technique.

The method of operation of the present invention will now be discussed in detail. First, the hopper is filled with the desired topping material. Motor throttle valve 150 is actuated to propel spreader 124 in the desired direction and at the desired velocity. As the spreader passes above the beginning of the wet concrete surface, control valve 152 is actuated, causing actuator cylinders 140 to snap gate 144 into the desired open position which is determined by stops 153 which have been previously adjusted. In a typical application, stops 153 will be adjusted to provide a ⅛" gap 148. Under normal operation a single pass of spreader 124 across bridge 10 will distribute topping at the rate of ¼ pound per square foot. If an application of one pound per square foot is desired, spreader 124 must make four sequential passes over the same area of web concrete. The topping is thus distributed in four separate blankets which has been found to produce far superior results than can be attained by a single higher topping distribution rate pass. At the end of the fourth pass, bridge 10 is laterally translated so that spreader 124 can then be translated across the next section of wet concrete four more times. To produce an application rate of 1-½ pounds per square foot, six passes of spreader 124 over the wet concrete would be provided.

It will be apparent to those skilled in the art that the disclosed concrete spreader system may be modified in numerous ways and may assume many embodiments other than the preferred forms specifically set out and described above. For example, a separate wheel could be coupled to the shaft of finger agitator 106 in a manner which would permit it to contact the surface of spans 16 and 18 of bridge 10. In this embodiment, finger agitator 106 would rotate at a rate proportional to the amount of translation of the spreader. Additionally, the spreader could be powered by a gas, electric or hydraulic motor and could be controlled by a computer or by a remote control means receiving radio or optical control signals. Numerous other similar modifications would be readily apparent to one skilled in the art. It is also apparent that the concrete topping spreader system of the present invention could be used to spread various types of topping materials over many different types of surfaces and would not necessarily require an elevated bridge of the type disclosed. Accordingly, it is intended by the appended Claims to cover all such modifications of the invention which fall within the true spirit and scope of the invention.

I claim:

1. Apparatus for uniformly spreading a topping material over a wet concrete surface area having a length, width and opposing sides, said apparatus comprising:

a. a spreader including a hopper for storing a supply of loose particulate topping material and for dispensing a uniformly wide layer of the topping material from an elongated slot in said hopper as said spreader is translated along a path;

b. bridge means supported above and spanning the width of the concrete surface area without contacting the concrete surface and translatable along the length of the concrete surface area for providing an elevated path to translate said spreader across a widthwise segment of the concrete surface area and for maintaining said spreader vertically spaced above and separated from the concrete surface;

c. means coupled to said spreader for metering the discharge of topping material from said elongated slot onto the widthwise segment of the concrete surface area at a rate proportional to the translation velocity of said spreader across said elevated bridge means and independent of the vertical spacing between said slot and the concrete surface;

d. control means coupled to said spreader and to said bridge means for permitting an operator located outside of the wet concrete surface area to remotely control the operation of said spreader; and e. drive means coupled to said spreader for translating said spreader across the elevated path formed by said bridge means over the wet concrete surface area to thereby dispense a uniform layer of topping material over the widthwise segment of the concrete surface area, whereby sequential translations of said spreader across said bridge means followed by sequential translations of said bridge means along the length of the concrete surface area in displacements equal to the width of the layer of topping material dispensed by said spreader covers the entire concrete surface area with a uniform layer of topping material.

2. The apparatus of claim 1 wherein said metering means includes gate means for covering and uncovering said slot by a predetermined, controllable amount.

3. The apparatus of claim 2 wherein said metering means further includes means positioned within said hopper and in proximity to said elongated slot for agitating the topping material within said hopper.

4. The apparatus of claim 3 wherein said agitating means further includes a rotating agitator.

5. The apparatus of claim 4 further including means coupled to said agitator and to said bridge means for rotating said agitator at a rate proportional to the rate of translation of said spreader across said bridge means.

6. The apparatus of claim 1 further including means coupled to a source of pressurized air for transmitting pressurized air to said spreader.

7. The apparatus of claim 6 further including an air vibrator coupled to said hopper for vibrating the hopper and the topping material within said hopper.

8. The apparatus of claim 2 wherein said gate means includes a gate having a curved upper surface formed as a cylindrical section for maintaining a continuous sliding contact with said elongated slot.

9. The apparatus of claim 1 wherein said control means further includes:

a. first means for controlling the direction of travel of said spreader; and b. second means for controlling the translation velocity of said spreader.

10. The apparatus of claim 1 further including means coupled to said spreader for vibrating said hopper and the topping material in said hopper.

11. Apparatus for uniformly spreading a topping material over a wet concrete surface area having a length, width and opposing sides, said apparatus comprising:

a. a spreader including a hopper for storing a supply of loose particulate topping material and for dispensing a uniformly wide layer of the topping material from an elongated slot in said hopper as said spreader is translated along a path, said hopper further including i. a first end member inclined at an angle to the vertical and including top and bottom surfaces; and ii. a second end member positioned opposite said first end member and including top and bottom surfaces, the bottom surfaces of said first and second members converging together to form said elongated slot;

b. means coupled to said first end member of said hopper for vibrating said first end member;

c. bridge means supported above and spanning the width of the concrete surface area without contacting the concrete surface and translatable along the length of the concrete surface area for providing an elevated path to translate said spreader across a widthwise segment of the concrete surface area and for maintaining said spreader vertically spaced above and separated from the concrete surface;

d. means coupled to said spreader for metering the discharge of topping material from said elongated slot onto the widthwise segment of the concrete surface area at a rate proportional to the translation velocity of said spreader across said elevated bridge means and independent of the vertical spacing between said slot and the concrete surface, said metering means including i. gate means coupled to said hopper and engaging said elongated slot for controlling the width of said slot; and ii. means positioned within said hopper and above said elongated slot for agitating the topping material within said hopper;

e. control means coupled to said spreader and to said bridge means for permitting an operator located outside of the wet concrete surface area to remotely control the back and forth translations of said spreader across said elevated bridge means; and f. drive means coupled to said spreader for translating said spreader across the elevated path formed by said bridge means over the wet concrete surface area to thereby dispense a uniform layer of topping material over the widthwise segment of the concrete surface area, whereby sequential translations of said spreader across said bridge means followed by sequential translations of said bridge means along the length of the concrete surface area in displacements equal to the width of the layer of topping material dispensed by said spreader covers the entire concrete surface area with a uniform layer of topping material.

* * * * *